US005335478A

United States Patent [19]

Aronsen

[11] Patent Number: 5,335,478

[45] Date of Patent: Aug. 9, 1994

[54] MULTI-COMPARTMENT DISPENSER POUCH AND METHOD OF MAKING

[76] Inventor: Arthur N. Aronsen, 24 La Espiral, Orinda, Calif. 94563

[21] Appl. No.: 2,253

[22] Filed: Jan. 8, 1993

[51] Int. Cl.[5] ..... B65B 3/02; B65B 9/08

[52] U.S. Cl. ..... 53/412; 53/455

[58] Field of Search ..... 53/412, 455, 562, 133.1, 53/133.2, 133.6, 474, 469

[56] References Cited

U.S. PATENT DOCUMENTS

| | | | |
|---|---|---|---|
| 2,913,861 | 11/1959 | Macneale | 53/455 |
| 3,246,444 | 4/1966 | Paisley | 53/412 |
| 3,340,669 | 9/1967 | Farquharson | 53/455 |
| 3,390,507 | 7/1968 | Repko | 53/412 |
| 3,471,351 | 10/1969 | Fuchs | 53/133.1 X |
| 3,507,087 | 4/1970 | Pratt | 53/455 X |
| 3,540,183 | 11/1970 | Bodolay et al. | 53/455 X |
| 3,940,905 | 3/1976 | Perry, 3rd | 53/412 |
| 4,201,031 | 5/1980 | Wiles | 53/562 X |
| 4,420,080 | 12/1983 | Nakamura . | |
| 4,552,269 | 11/1985 | Chang . | |
| 4,616,470 | 10/1986 | Nakamura | 53/412 |

*Primary Examiner*—Horace M. Culver
*Attorney, Agent, or Firm*—Thomas R. Lampe

[57] ABSTRACT

A dispenser pouch has outer walls and a divider wall sealed to the outer walls to provide two separate compartments containing product. Each outer wall has a dispensing aperture formed therein communicating with one of the compartments. A closure flap is connected to each of the outer walls and positionable over a dispensing aperture. The invention also encompasses a method for forming the dispensing pouch.

5 Claims, 6 Drawing Sheets

MULTI-COMPARTMENT DISPENSER POUCH AND METHOD OF MAKING

TECHNICAL FIELD

This invention relates to a container utilized to store and dispense product. More particularly, the container is a multi-compartment dispenser pouch which enables the consumer to selectively remove product from dispensing apertures formed on opposed sides of the pouch and communicating with different compartments. The present invention is also concerned with a method of forming such a dispenser pouch. The container is resealable and may be employed, for example, to store and dispense towelettes.

BACKGROUND ART

Pouch-like, re-sealable dispenser-containers are known in the prior art. It is also known to dispense towelettes and similar sheet materials from stacks contained in dispenser-containers.

U.S. Pat. No. 4,420,080, issued Dec. 13, 1983, discloses a plurality of re-sealable dispenser-container embodiments adapted for the storage and dispensing of towelettes and the like. The towelettes may, if desired, be wetted with water, toilet water, medicinal liquids, and the like. One or more flaps are associated with the container to open or reseal same, as desired.

Among the embodiments disclosed in U.S. Pat. No. 4,420,082 are several which disclose a partition in the interior to divide the interior of the container into two spaces. It is also generally suggested in the patent that openings are provided at opposed sides of the container, each communicating with a different space. However, there is no suggestion in the patent as to how such a multi-spaced container is manufactured. While the patent does disclose in schematic fashion the steps employed to manufacture a pouch, the completed pouch or container has a fin-type seal formed at the center of one side thereof and such an approach would not allow for the manufacture of a multi-space pouch having central access openings on opposed sides thereof.

U.S. Pat. No. 4,552,269 is directed to a container with a re-sealable sealing device consisting of a paper of foil blank and a sealing flap which can be produced by die cutting. A pressure sensitive adhesive is used to make the sealing flap of the container resealable. Die cut tear prevention holes are used to prevent the sealing flap from tearing away from the container. There is no teaching in this patent of a multi-compartment container or method of making same.

U.S. Pat. No. 4,616,470, issued Oct. 14, 1986, discloses a process for producing a re-sealable dispenser-container. This patent was issued to the same inventor as aforereferenced U.S. Pat. No. 4,420,080 and adds nothing insofar as disclosure of a multi-compartment pouch or dispenser-container and manufacture thereof is concerned. The remarks provided above with respect to U.S. Pat. No. 4,420,080 are equally applicable to U.S. Pat. No. 4,616,470.

DISCLOSURE OF INVENTION

The present invention relates to an improved multi-compartment dispenser pouch and to a method of forming such a pouch.

The dispenser pouch of the present invention has opposed, flexible outer walls having peripheral edges joined together to define a closed interior and a divider wall disposed between the outer walls and secured between the peripheral edges dividing the interior into two separate compartments containing product.

The outer pouch walls each define a dispensing aperture communicating with one of the compartments spaced from the peripheral edges and allowing selective manual access to the compartments to dispense product therefrom. The dispenser pouch further includes a closure flap connected to each of the outer walls and selectively positionable over a dispensing aperture.

The method of the present invention includes the step of transporting a first web of flexible material along a predetermined path of movement.

During the transporting step, the first web is cut to form dispensing apertures at spaced locations on the first web.

During the transporting step, the first web is folded along a fold line to bring portions of the first web into overlapping relationship to form the opposed outer walls, each of the portions defining dispensing apertures.

A second web is positioned between the overlapping portions of the first web to form the divider wall and divide the interior into two compartments.

The next step involves the initial sealing of the outer walls and the divider wall together at preselected locations thereon to form a dispenser pouch having an open end communicating with both compartments of the interior.

Product, such as towelettes, for example, is inserted through the open end. The outer walls and the divider wall are then further sealed to close the open end.

The second web is wider than the overlapping first web portions whereby a segment of the second web projects from the open end after the outer walls and divider wall are initially sealed at the preselected locations. Product is inserted into the compartments in sequential stages during the inserting step, the second web segment being moved to alternate locations during the inserting step for engagement by product to sequentially guide product into alternate preselected compartments.

Again referring to the dispenser pouch construction, as noted above, the outer walls are each formed of a planar, joint-free plastic sheet defining a dispensing aperture communicating with one of the compartments spaced from the peripheral edges and allowing selective manual access to the compartments to dispense product therefrom.

Flexible closure flaps are secured to the outer walls adjacent to the dispenser apertures defined thereby by a first adhesive applied to a first portion of the flexible closure flaps permanently bonding the flexible closure flaps to the outer walls.

The flexible closure flaps have a second adhesive secured thereto on a second portion thereof, the second adhesive selectively releasably securing the flexible closure flaps over the dispensing apertures.

The outer walls are formed from a unitary sheet of plastic film material folded along a fold line at one of the edges.

The outer walls and the divider wall are of multi-laminate plastic film construction with at least one of the laminates of each of the outer walls and divider wall comprising polyethylene, heat sealing between the outer walls and divider wall being formed between polyethylene laminates.

It is preferred that the outer walls include a layer of polyethylene bonded to a layer of thermoplastic film forming a moisture and/or odor barrier, hereinafter referred to as barrier film, the layer of barrier film being the outermost layer of the outer walls. The divider wall preferably comprises an inner layer of barrier film, which may, for example, be nylon film, sandwiched between layers of polyethylene.

Other features, advantages, and objects of the present invention will become apparent with reference to the following description and accompanying drawings.

BEST MODE FOR CARRYING OUT THE INVENTION

Figure 1:
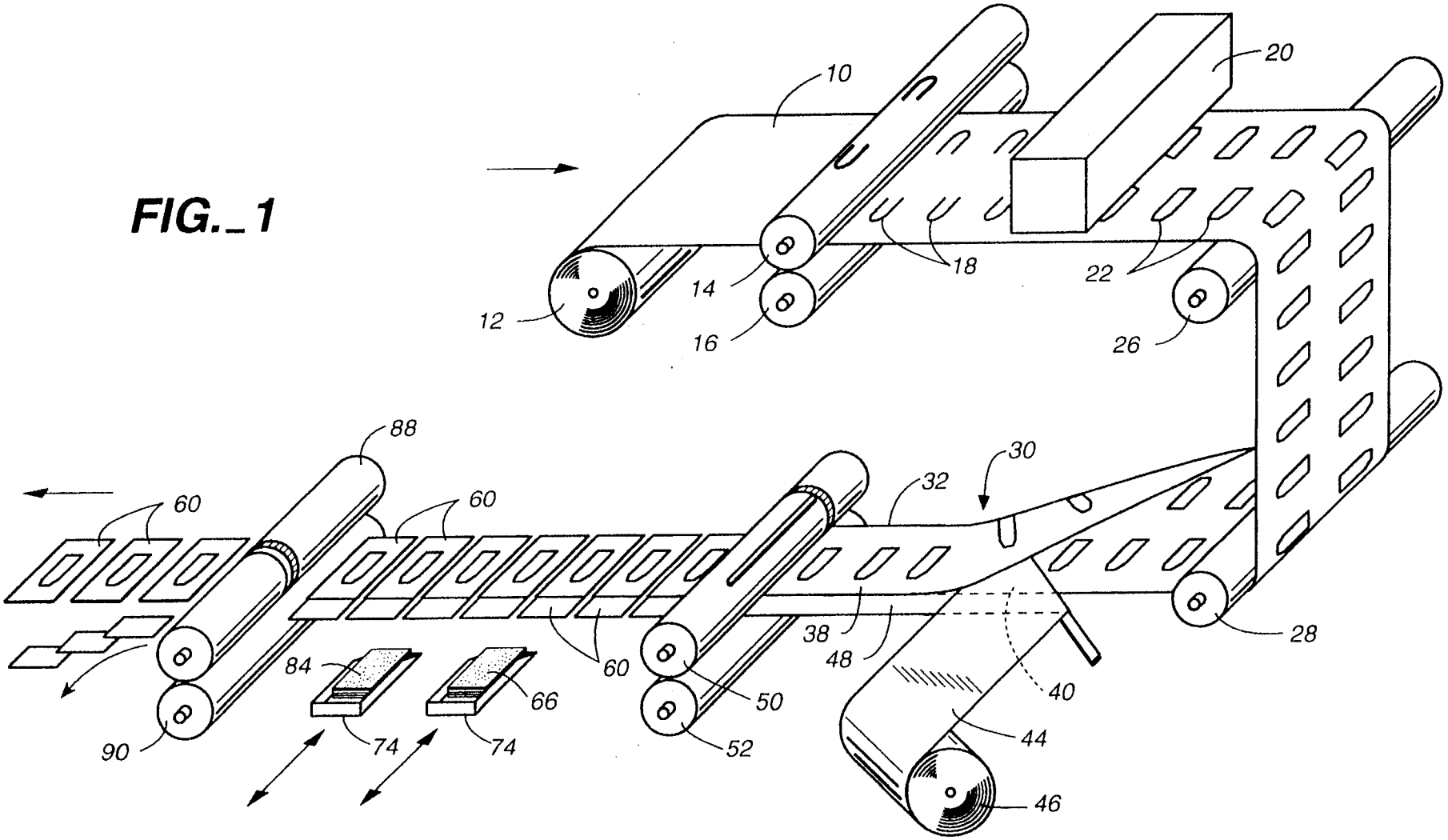
FIG. 1 is a diagrammatic illustration of a representative manufacturing line carrying out steps involved during manufacture of the dispenser pouch of the present invention.
Figure 2:
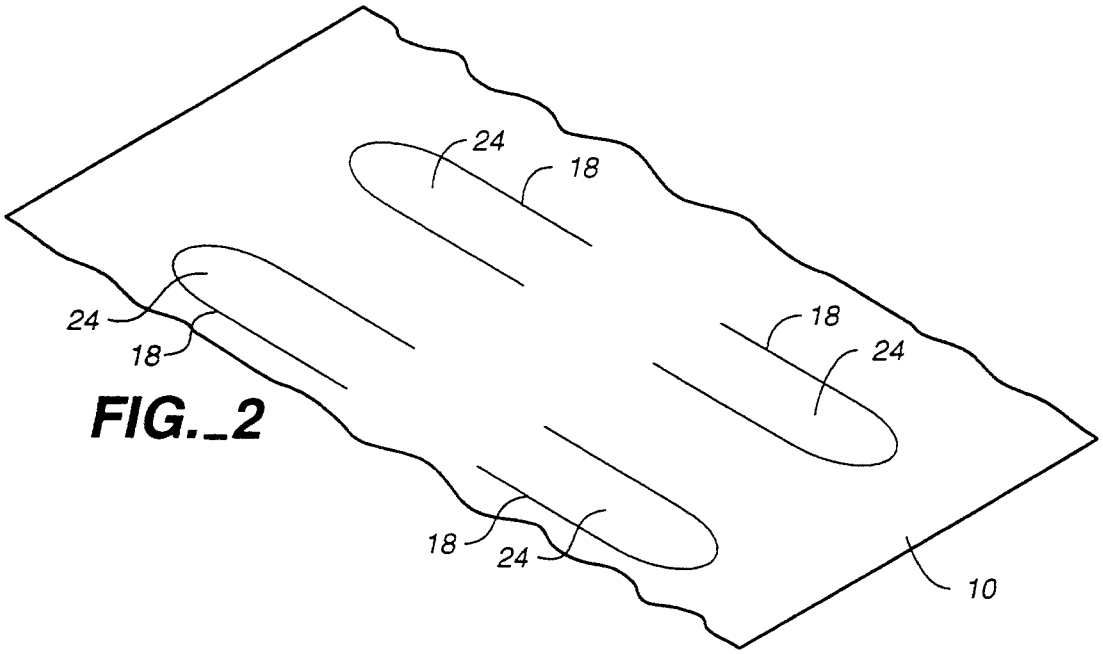
FIGS. 2 through 6 are perspective views illustrating sequential steps being carried out during the manufacture of the dispenser pouch.

FIG. 1 illustrates in diagrammatic form a typical scheme or layout for manufacturing a dispenser pouch in accordance with the teachings of the present invention. A first web of flexible material 10 is unwound from a roll 12 thereof and passed through the nip of die cutting rollers 14, 16. The die cutting rollers form generally U-shaped cuts 18 in the web 10. As shown in FIGS. 1 and 2, the cuts 18 are disposed in pairs at spaced locations along the length of the first web.

Figure 3:
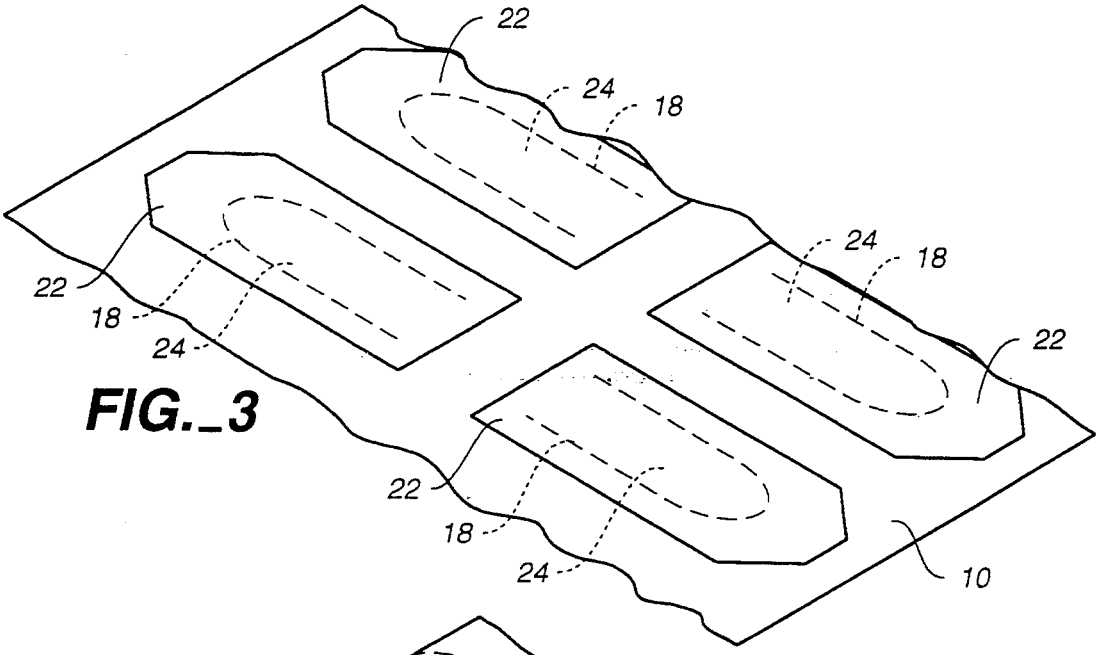

Next, the web 10 passes under a label applicator device 20 of any suitable, known, commercially available type. One suitable device is the Model #110 LH applicator made available by Autolabe. The label applicator applies pressure sensitive, adhesive coated flexible closure flaps or labels 22 to the web 10 over the cuts 18 and the inner flaps 24 defined thereby (see FIG. 3). The inner flaps, which adhere to the pressure sensitive closure flaps or labels, when lifted, form dispensing apertures. The closure flaps 22 may have indicia thereon or be free of same, as desired.

First web 10 then proceeds about support rolls 26, 28 to a folding station 30 at which the first web 10 is folded along a fold line 32 to bring portions of the first web into overlapping relationship and form the opposed outer walls 38, 40 of the dispenser pouches being manufactured.

Figure 4:
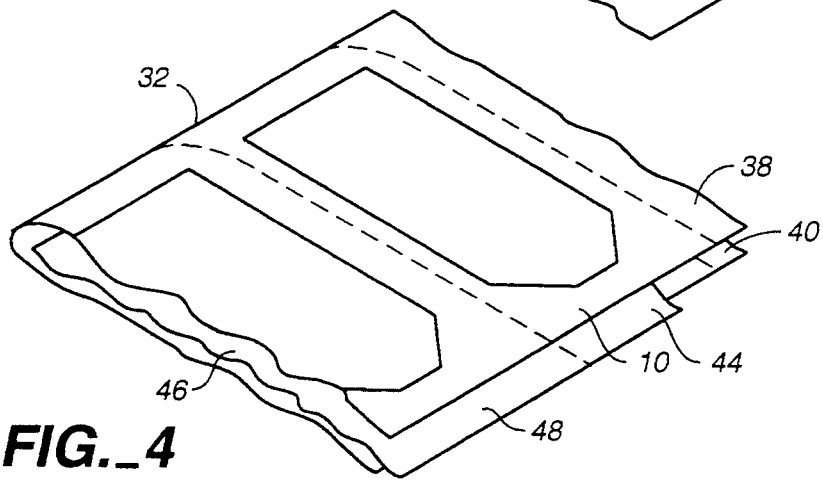
Figure 4A:
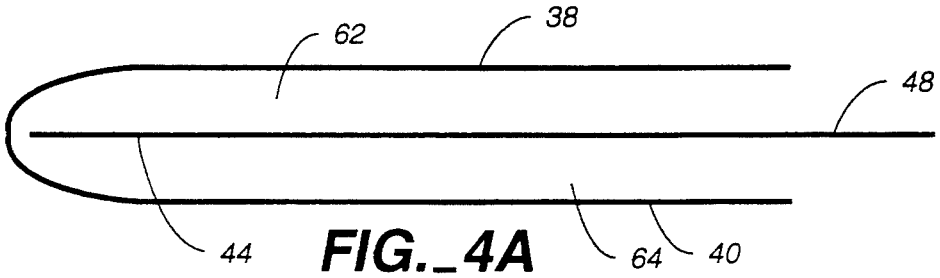
FIGS. 4A, 5A, and 6A are diagrammatic presentations of pouch constructed in accordance with the teachings of the present invention as taken from the side of the pouch and illustrating sequential steps involved when filling the pouch chambers with product.

At the folding station 30, a second web of flexible material 44 is unwound from a roll 46 thereof and positioned between the overlapping portions of the first web. This is shown in FIGS. 4 and 4A in somewhat diagrammatic fashion. The web 44 has a width greater than that of the outer walls 38, 40 so that the web 44 not only comprises the divider wall 46 in the pouch construction but also has a segment 48 projecting from the outer walls 38, 40 of the pouch.

After insertion of the web 44 between the overlapping portions of the first web forming outer walls 38, 40, the assemblage is conveyed through two cutter-sealer rolls 50, 52. Rolls 50, 52 cut through outer walls 38, 40 and divider wall 46 at the locations indicated by the dash lines in FIG. 4. Simultaneously with this cutting action the heated rolls heat seal the walls 38, 40 and 46 together along the lines of cut, thus creating sealed edges 54, 56.

Additionally, the rolls 50, 52 operate to form a sealed edge 58 in the vicinity of fold line 32 which seals the divider wall 46 to the outer walls 38, 40 in fluid-tight fashion. That is, the pouch structure after emerging from the nip of rolls 50, 52 has a continuous heat sealed edge of a generally U-shaped configuration extending along three sides of the pouch structure, with one end thereof (the end from which segment 48 projects) being open.

The pouches formed after passage through rolls 50, 52 are designated by reference numeral 60. Pouches 60 are next conveyed by any suitable form of conveyance to a pouch filling station wherein product is inserted into the pouches. It will be appreciated that each pouch 60 has two compartments defined by the outer walls 38, 40 and divider wall 46. The compartments of the pouch are designated in the drawings by reference numerals 62 and 64. The compartments are completely separated from one another by the divider wall 46 so that the contents of one compartment will be isolated from the contents of the other compartment. This is important for example, where the compartments hold two different types of product, such as a wet towelette in one compartment and a dry towelette in the other. Separate communication may be had to each compartment through a dispensing aperture defined by cut 18 upon lifting of closure flap 22 and its associated inner flap 24.

Referring now to FIGS. 1, 5, 5A and 10, the next step carried out is the insertion of product into one of the compartments. In the figures just referenced, the compartment to be filled is compartment 62. The product to be inserted into the compartment is, by way of example, a stack 66 of towelettes 68.

Figure 5A:
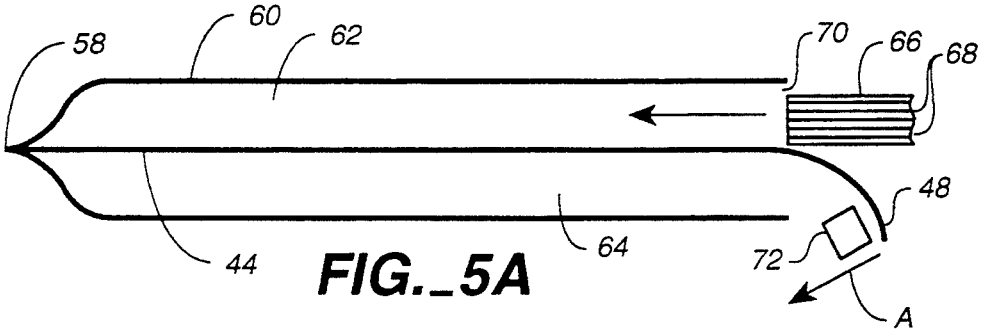
Figure 5:
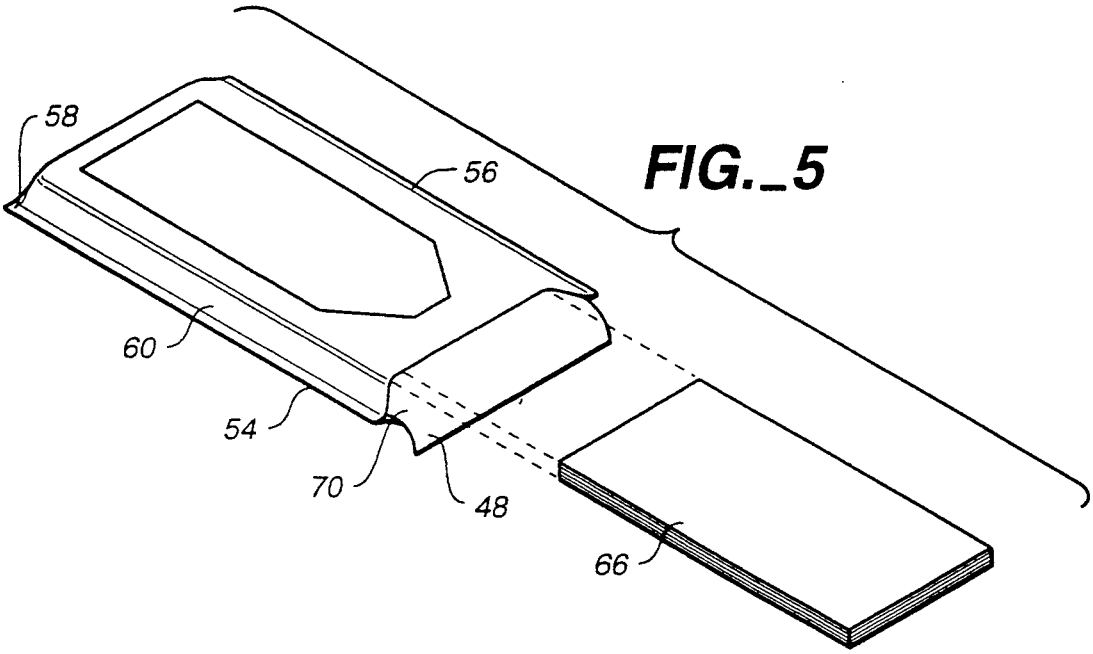

Insertion is accomplished through the open or unsealed end 70 of the pouch 60. Vacuum or other means is utilized to pull outer wall 38 away from divider wall 44 in the vicinity of the open end so that sufficient clearance exists for the insertion of the stack 66 into compartment 62. In addition, at this stage of the operation, the segment 48 of the divider wall passes a vacuum bar 72 which applies a vacuum to segment 48 as shown in FIGS. 5 and 5A in the direction of the arrow A and bends the segment 48. The segment 48, being curved away from the entrance to compartment 62, assists in guiding the stack 66 into position.

Figure 10:
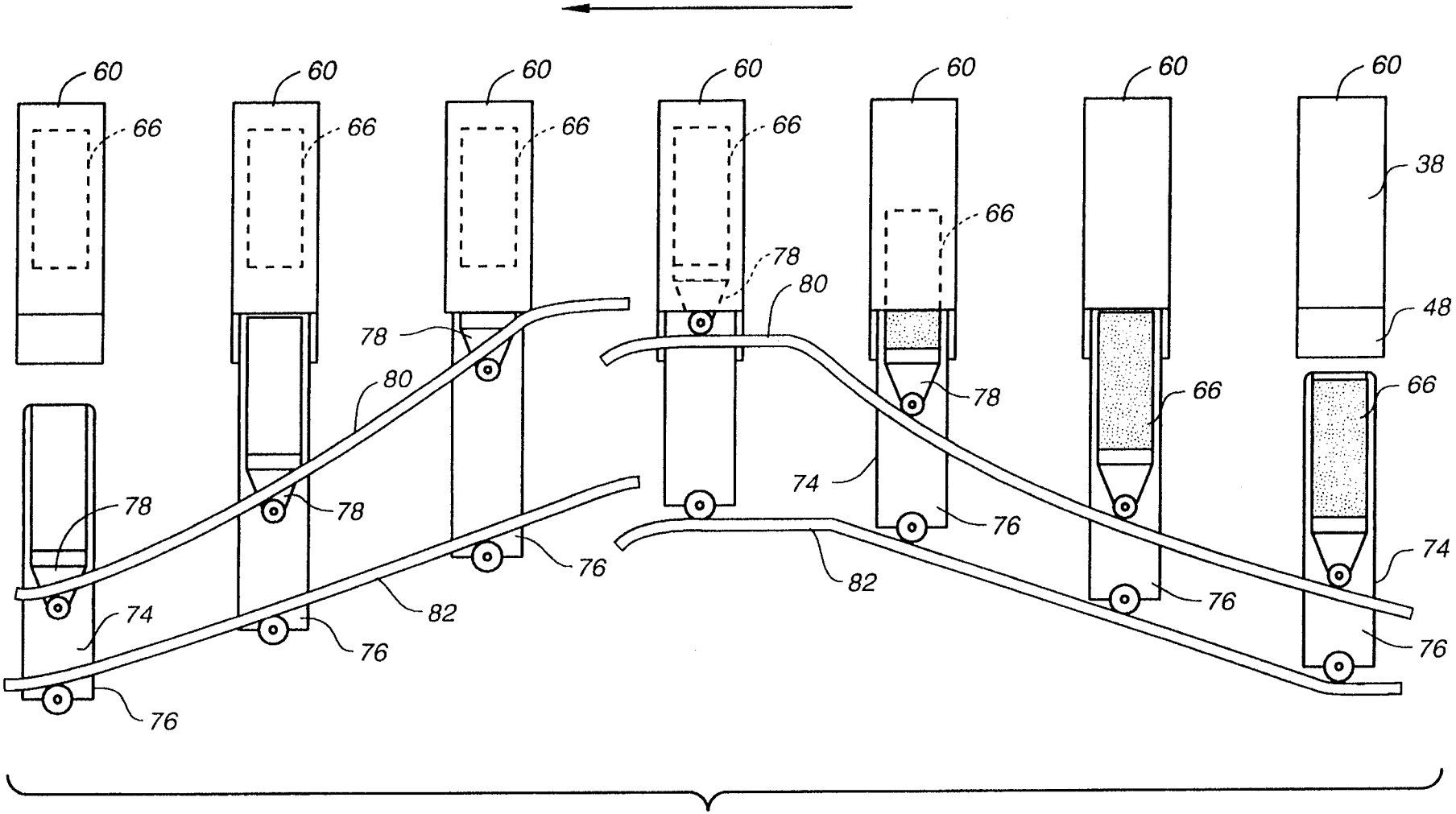
FIG. 10 is a diagrammatic illustration of a preferred approach for inserting product into the dispenser pouch compartments.

FIG. 10 illustrates in diagrammatic fashion a preferred arrangement for insertion of stack 66 into compartment 62. As the pouches 60 are conveyed in the direction of the arrow shown in that figure, they pass by a filler mechanism including a plurality of filler devices 74. These devices are conveyed at the same speed at the pouches. Each filler device 74 has two sections, a base unit 76 and a pusher unit 78 supported by the base unit and moveable relative thereto. A stack 66 of towelettes is positioned on the filler device with an edge of the stack in engagement with the pusher unit.

The base and pusher units of each filler device 74 are in operative engagement with tracks 80, 82 which serve to control movement thereof. Proceeding from right to left when viewing FIG. 10, it will be seen that the insertion step is accomplished in two stages. First, the entire filler device 70 approaches the pouch and is positioned over segment 48 of the divider wall 46. Then, the base unit enters the open end 70 of the pouch. Next, the base unit stops relative with the pouch while the pusher unit 78 continues its movement into the pouch to fully position the stack 66 in compartment 62. Finally, the tracks 80, 82 cooperate with the filler device 74 to completely withdraw it from the pouch, leaving the stack 66 in place therein.

Figure 6A:
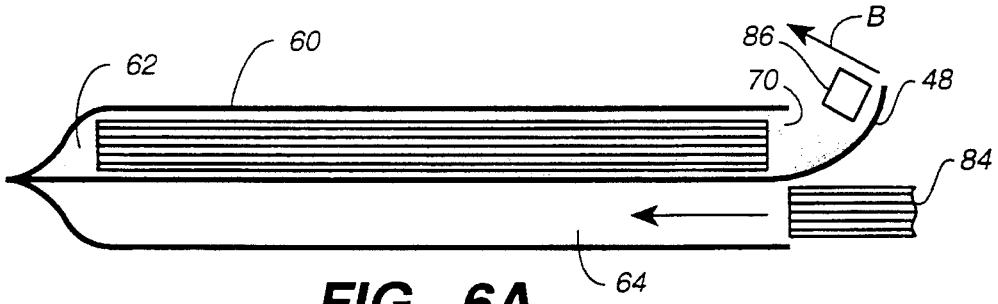
Figure 6:
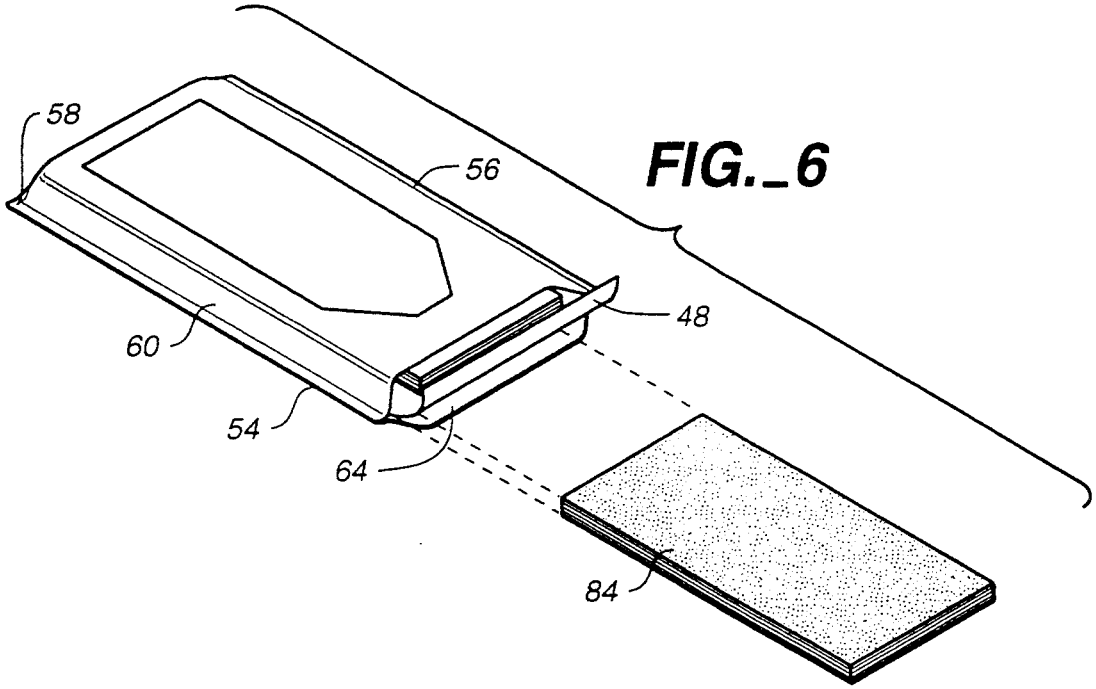

Next, compartment 64 is filled by a stack 84. This is illustrated in FIGS. 6, 6A. In FIG. 6A, the segment 48 is shown being bent and drawn away from compartment 64 by a second vacuum bar 86 applying a vacuum to the segment in the direction of arrow B. Actual insertion is accomplished by a suitable mechanism such as that illustrated in FIG. 10. The stack 84 may be of a product differing from that in the stack 66, for example, moistened towelettes as opposed to unmoistened towelettes.

Figure 7A:
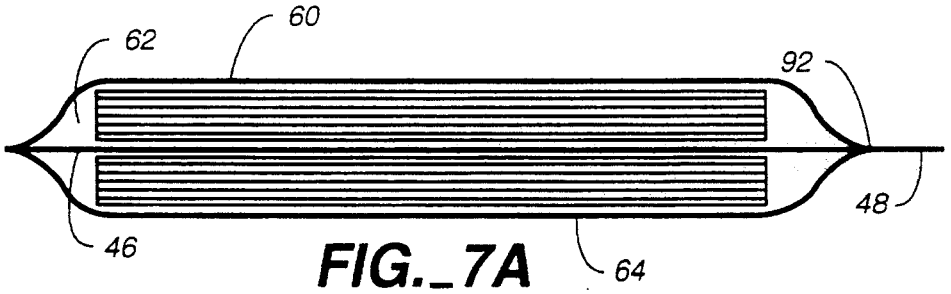
FIG. 7A is a diagrammatic presentation of a form of the pouch in which the divider wall projects beyond the outer walls after the pouch is formed and filled.
Figure 7:
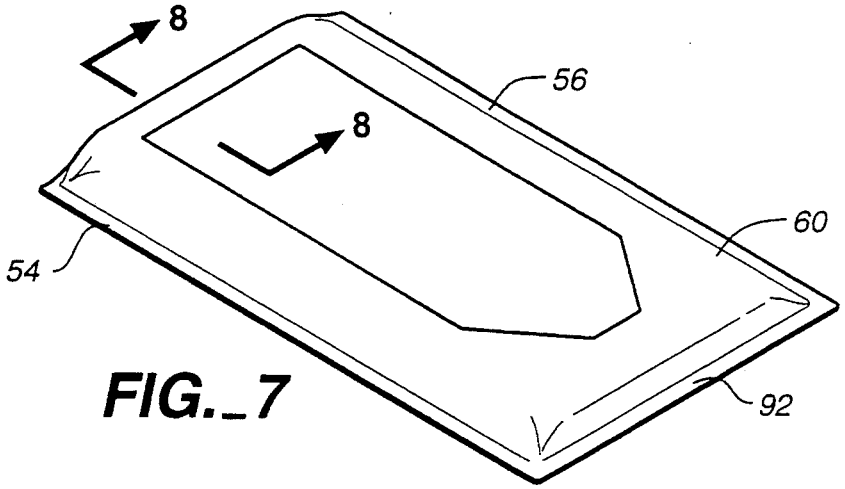
FIG. 7 is a perspective view of a filled and formed dispenser pouch.
Figure 8:
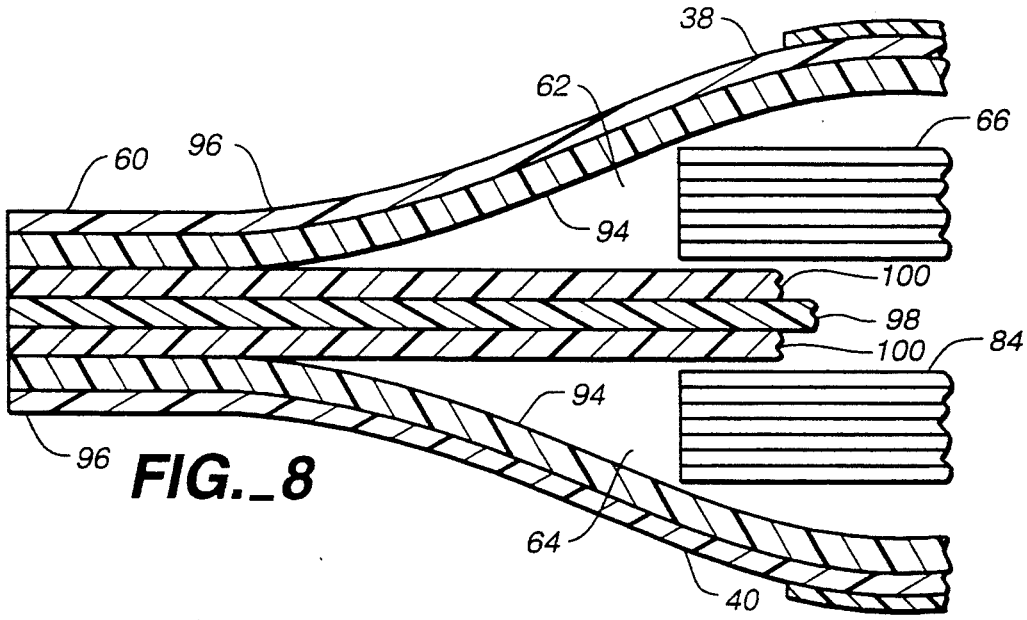
FIG. 8 is an enlarged, cross-sectional view of a portion of a filled pouch taken along the line 8—8 in FIG. 7.

The filled pouches 60 are now passed through rollers 88, 90 which heat seal the open end 70 of the pouch 60 so that the compartments 62, 64 are completely isolated from each other and from the outside of the pouch. The seal at this end is designated in FIGS. 7 and 7A by reference numeral 92. In the pouch shown in FIG. 7, the rollers 88, 90 have also served to cut off the segment 48 from the remainder of the pouch. However, if desired, the rollers 88, 90 may perform a sealing function only, so that the segment 48 remains integral with divider wall 46, as shown in FIG. 7A. The retained segment may perform a desired function with respect to the completed pouch, such as employment as a hanger flap for display and sale purposes.

Certain additional details regarding the construction of the pouch 60 are worthy of note. Preferably, the first and second webs of flexible material employed to manufacture the pouch are of multi-laminate plastic construction. More specifically, the outer walls 38, 40 include a layer of polyethylene 94 bonded to a layer of thermoplastic barrier film 96. Certain thermoplastic barrier films do not have good heat seal properties when applied to other plastic materials. Polyethylene, on the other hand, does have good heat seal properties, making it more applicable and suitable for the disclosed converting operation.

The divider wall 46 preferably comprises an inner layer of barrier film 98 sandwiched between layers 100 of polyethylene. This promotes a highly effective heat seal bond at the edges of the pouch.

Figure 9:
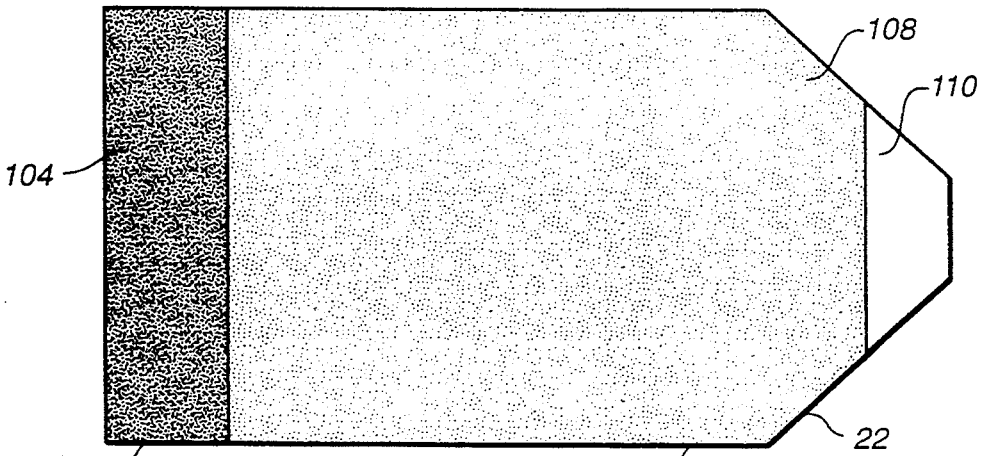
FIG. 9 is a plan view of a closure flap employed in the pouch construction.

The pouch also incorporates a unique closure flap structure. The adhesive side of a closure flap 22 is shown in FIG. 9. A first portion 102 of the flexible closure flap element has a first adhesive 104 applied thereto. Adhesive 104 is of any suitable permanent bonding type, such as Adhesive #33-4040 made available by National Starch, and the adhesive 104 and first portion 102 are applied to the outer walls of the pouch at a location immediately adjacent to the dispensing aperture in the pouch covered by inner flap 24 at the attached end of the inner flap.

A second portion 106 of the closure flap is covered with a second adhesive 108 which is of a resealable character, such as Adhesive #33-4031 made available by National Starch. Second closure flap portion 106 and second adhesive 108 cover the inner flap 24 and portions of the pouch outer wall surrounding three sides of the inner flap. When the closure flap 22 is lifted at its end 110, which is free of adhesive altogether, the bond of adhesive 108 will be sufficient to raise the inner flap 24 and allow access to a compartment through the dispensing aperture in the associated outer wall thus created. The permanent bond between adhesive 104 and the outer wall will prevent complete removal of the closure flap from the remainder of the pouch. A consumer can simply reseal the dispensing aperture by again placing the entire closure flap in abutting engagement with the outer wall.

I claim:

1. A method of forming a flexible dispenser pouch having two compartments containing product, at least one of said compartments containing a sheet material product, said dispenser pouch having opposed, flexible outer walls having peripheral edges joined together to define a closed interior and a divider wall disposed between said outer walls and secured between said peripheral edges dividing said interior into two separate compartments containing product, said outer walls each defining a dispensing aperture communicating with one of said compartments spaced from said peripheral edges and allowing selective manual access to the compartments to dispense product therefrom, and said dispenser pouch further including a closure flap connected to each of said outer walls and selectively positionable over a dispensing aperture, said method comprising the steps of:

transporting a first web of flexible material along a predetermined path of movement;

during said transporting step, cutting said first web to form said dispensing apertures at spaced locations on said first web;

during said transporting step, folding said first web along a fold line to bring portions of said first web into overlapping relationship and form said opposed outer walls, each of said portions defining dispensing apertures;

positioning a second web between the overlapping portions of said first web to form said divider wall and divide the interior into said two compartments;

initially sealing said outer walls and said divider wall together at preselected locations thereon to form a dispenser pouch having an open end communicating with both compartments of said interior;

inserting product into both of said compartments through said open end, said inserting step for sheet material product being accomplished in sequential first and second stages, said first stage comprising supporting the sheet material product and conveying the supported sheet material product to a first location wherein the sheet material product is located at an open end communicating with a compartment and said second stage comprising pushing the sheet material product from the first location to a second location wherein said sheet material product is wholly within a compartment; and after said inserting step, further sealing said outer walls and said divider wall to close said open end to seal product in each compartment and maintain separation between product in different compartments.

2. The method according to claim 1 wherein said second web is wider than said overlapping first web portions whereby a segment of said second web projects from said open end after said outer walls and divider wall are initially sealed at said preselected locations, said method including the step of moving said second web segment to alternate locations during said inserting step for engagement by product to sequentially guide product into alternate preselected compartments.

3. The method according to claim 1 wherein said first and second webs are multilaminate plastic webs having a polyethylene layer, said polyethylene layers of said first and second webs being heat sealed together during said initial and further sealing steps.

4. The method according to claim 2 wherein said second web segment is moved to said alternate locations by applying a vacuum to said second web segment during transport of said first and second webs.

5. The method according to claim 1 including the step of applying closure flaps over said dispensing apertures during transport of said first web, said step of applying closure flaps over said dispensing apertures including applying first and second adhesives to a discrete flexible closure element at predetermined locations on said closure element, and bringing said flexible closure element into engagement with said first web with said first adhesive out of registry with said dispensing aperture and said second adhesive in at least partial registry with said dispensing aperture and an area of said first web immediately adjacent to said dispensing aperture, said first adhesive forming a permanent bond with said first web and said second adhesive forming a releasable bond with said first web.

* * * * *